United States Patent [19]

Kuriyama et al.

[11] Patent Number: 4,756,167

[45] Date of Patent: Jul. 12, 1988

[54] HELIUM COOLING APPARATUS

[75] Inventors: Toru Kuriyama, Yokohama; Hideki Nakagome, Tokyo, both of Japan

[73] Assignee: Kabushiki Kaisha Toshiba, Kawasaki, Japan

[21] Appl. No.: 43,445

[22] Filed: Apr. 28, 1987

[30] Foreign Application Priority Data

May 6, 1986 [JP] Japan ..... 61-103408

[51] Int. Cl.[4] ..... F25B 19/00

[52] U.S. Cl. ..... 62/514 R; 62/54; 165/133

[58] Field of Search ..... 62/54, 514 R; 165/133

[56] References Cited

U.S. PATENT DOCUMENTS

| | | | |
|---|---|---|---|
| 2,831,549 | 4/1958 | Alpert | 62/55.5 |
| 4,159,739 | 7/1979 | Brothers et al. | 165/133 |
| 4,543,794 | 10/1985 | Matsutani et al. | 62/514 R |
| 4,599,866 | 7/1986 | Nakagome et al. | 62/3 |

OTHER PUBLICATIONS

Transaction of the ASME, vol. 103, (1981), pp. 96–102, "Optimized Performance of Condensers With Outside Condensing Surface", Y. Mori, et al.

Cryogenics, Apr. 1984, "Interfacing Small Closed-Cycle Refrigerators to Liquid Helium Cryostats", R. C. Longsworth.

*Primary Examiner*—Ronald C. Capossela

*Attorney, Agent, or Firm*—Oblon, Fisher, Spivak, McClelland & Maier

[57] ABSTRACT

A helium cooling apparatus according to the present invention comprises a refrigerator for cooling a refrigerant. The refrigerator is connected with the proximal end of a transfer line, which is used to transport the refrigerant. A port with a predetermined diameter is formed in a liquid-helium container which contains liquid helium. A condensation-heat exchanger, which is connected to the distal end of the transfer line, is inserted into the liquid-helium container through the port. A heat-transfer surface of the heat exchanger is formed with a plurality of grooves extending in the gravitational direction. The refrigerant is evaporated in the heat exchanger, and condensed liquid helium, adhering to the heat-transfer surface, drops along the grooves when helium gas in the liquid-helium container is cooled to be recondensed. Accordingly, the heat-transfer surface cannot be covered with the condensed liquid helium, so that a wide heat-transfer area can be secured. Thus, the heat transfer coefficient of the heat exchanger is improved considerably. In this arrangement, therefore, the port of the liquid-helium container, through which the exchanger is inserted into the container, need not have a large diameter.

7 Claims, 3 Drawing Sheets

HELIUM COOLING APPARATUS

BACKGROUND OF THE INVENTION

The present invention relates to a helium cooling apparatus in which gas helium in a liquid-helium container is cooled to be recondensed, and more particularly to a helium cooling apparatus in which a condensation-heat exchanger in the liquid-helium container has an improved heat transfer coefficient.

Conventionally, a liquid-helium container for cooling a superconducting coil and the like is disposed adiabatically in a cryostat. A helium cooling apparatus is used to cool and recondense gas helium in the liquid-helium container. To attain this, the cooling apparatus comprises a refrigerator for cooling a refrigerant, and a condensation-heat exchanger for evaporating the refrigerant to cool the gas helium. In general, helium cooling apparatuses can be classified into two types. In one type, the refrigerator is incorporated in the cryostat, and the condensation-heat exchanger is located in the liquid-helium container. In the other type, an exclusive-use cylindrical member extends from an exclusive-use port in the liquid-helium container to the outside of the cryostat. The heat exchanger is inserted into the helium container through the port and the cylindrical member for exclusive use. The refrigerator is disposed inside the cylindrical member or outside the cryostat.

In maintaining the refrigerator, in the case of the first type, the refrigerator must be disassembled, repaired, and reassembled after the temperature of the helium in the liquid-helium container is raised. In this type, therefore, the refrigerator cannot be maintained with ease.

In the case of the second type, on the other hand, the helium cooling apparatus can be mounted or demounted easily, without causing the liquid helium in the container to be discharged. In the second type, therefore, the refrigerator can be maintained without increasing the temperature of the helium in the helium container. Thus, as regards the maintenance of the refrigerator, the helium cooling apparatus of the second type has an advantage over the first type.

The performance of the helium cooling apparatus depends on that of the refrigerator and the heat transfer coefficient of the condensation-heat exchanger. In order to improve the performance of the cooling apparatus, therefore, the heat transfer coefficient of the exchanger must be improved. Thus, the heat-transfer area of the heat exchanger is expected to be increased.

In the helium cooling apparatus of the second type, however, the diameters of the port and the cylindrical member for exclusive use depend on the size of the condensation-heat exchanger. If the heat-transfer area of the heat exchanger becomes greater, therefore, the diameter of the exchanger, and hence, those of the port and the cylindrical member, are increased in proportion. Thus, the amount of heat introduced into the liquid-helium container, through the port and the cylindrical member, increases. The introduced heat lowers the thermal efficiency of the whole cooling apparatus.

Since the diameter of the prior art condensation-heat exchanger is considerably large, moreover, the helium cooling apparatus of the second type cannot be applied to a liquid-helium container without an exclusive-use port.

SUMMARY OF THE INVENTION

The object of the present invention is to provide a helium cooling apparatus, in which a condensation-heat exchanger enjoys an improved heat transfer coefficient and a reduced diameter, so that a port of a liquid-helium container, through which the heat exchanger is inserted into the container, can be reduced in diameter.

A helium cooling apparatus according to the present invention comprises a refrigerator for cooling a refrigerant. The refrigerator is connected with the proximal end of a transfer line, which is used to transport the refrigerant. A port with a predetermined diameter is formed in a liquid-helium container which contains liquid helium. A condensation-heat exchanger, which is connected to the distal end of the transfer line, is inserted into the liquid-helium container through the port. A heat-transfer surface of the heat exchanger is formed with a plurality of grooves extending in the gravitational direction. The refrigerant is evaporated in the heat exchanger, so that helium gas in the liquid-helium container is cooled to be recondensed. The condensed liquid helium, adhering to the heat-transfer surface, drops along the grooves. Accordingly, the heat-transfer surface cannot be covered with the condensed liquid helium, so that a wide heat-transfer area can be secured. Thus, the heat transfer coefficient of the heat exchanger is improved considerably. Therefore, the condensation-heat exchanger of the invention is smaller in diameter than the prior art heat exchanger. In this arrangement, the port of the liquid-helium container, through which the exchanger is inserted into the container, need not have a large diameter. Therefore, the amount of heat entering the container through the port is very small. Since the heat exchanger is small-sized, moreover, the port for the insertion thereof need not always be an exclusive one. Thus, the condensation-heat exchanger according to the present invention may be used also in a liquid-helium container without an exclusive-use port.

DETAILED DESCRIPTION OF THE PREFERRED EMBODIMENTS

Figure 1:
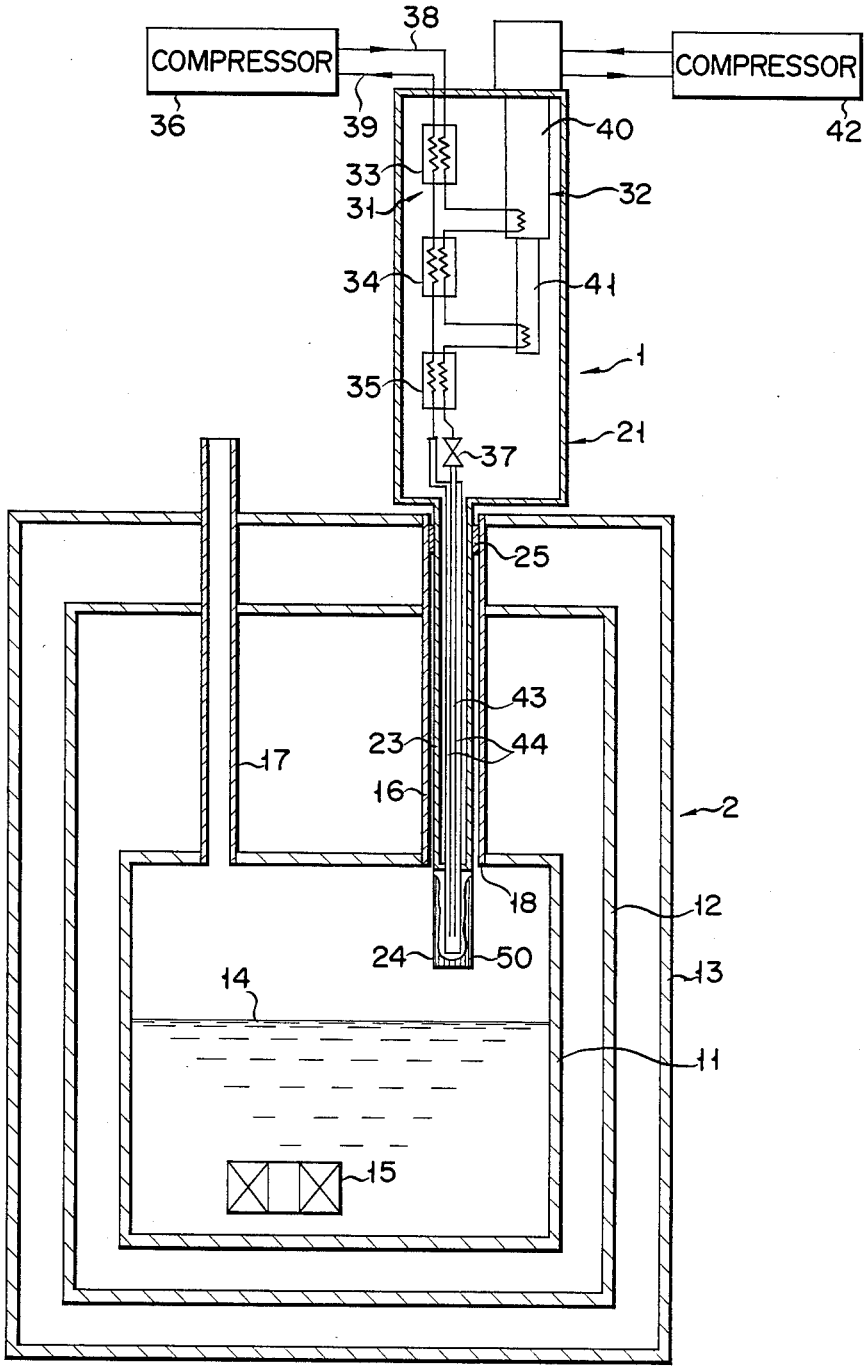
FIG. 1 is a sectional view of a cryostat incorporating a helium cooling apparatus according to the present invention.

Referring now to FIG. 1, there is shown cryostat 2 which incorporates helium cooling apparatus 1 according to the present invention. Cryostat 2 comprises liquid-helium container 11, heat-shielding plate 12, and vacuum container 13. Container 11 is filled with liquid helium 14. Object 15 of cooling (e.g., superconducting magnet) is immersed in liquid helium 14. A space between containers 13 and 11 is kept at a vacuum and insulated thermally. Heat-shielding plate 12 is cooled by liquid nitrogen, for example.

Liquid-helium container 11 has port 18, to which is attached liquid-helium injection pipe 16 which opens to the outside. Container 11 is fitted with helium gas recovery pipe 17 which opens to the outside. After liquid helium 14 is put into container 11, injection pipe 16 is closed. When helium 14 is evaporated by heat introduced into container 11, the resulting vapor is recovered through recovery pipe 17.

Helium cooling apparatus 1 according to the present invention comprises refrigerator 21 for cooling gas helium as a refrigerant, condensation-heat exchanger 24 for evaporating the refrigerant, thereby cooling the inside of liquid-helium container 11, and transfer line 23 connecting refrigerator 21 and heat exchanger 24. Refrigerator 21 includes first and second cooling systems 31 and 32, both of which are closed-cycle systems. First cooling system 31 has three heat exchangers 33, 34 and 35. Exchanger 33 is connected to compressor 36. Outgoing line 38, which extends from compressor 36, is connected to Joule-Thomson valve 37 via heat exchangers 33, 34 and 35. Return line 39, which extends from transfer line 23, is connected to compressor 36 via heat exchangers 35, 34 and 33. Thus, the refrigerant flowing through outgoing line 38 is cooled by the refrigerant flowing through return line 39. Also, the refrigerant in line 38 is cooled by second cooling system 32, which has two heat exchangers 40 and 41. Exchanger 40 is connected to compressor 42. The refrigerant flowing through outgoing line 38 is cooled further by exchangers 40 and 41.

Transfer line 23 is composed of inner and outer pipes 43 and 44. Outgoing and return lines 38 and 39 are connected to pipes 43 and 44, respectively. Thus, the refrigerant is fed through inner pipe 43, and is evaporated by condensation-heat exchanger 24, and then returned through outer pipe 44. The outside diameter of transfer line 23 is smaller than the inside diameter of liquid-helium injection pipe 16.

Figure 2:
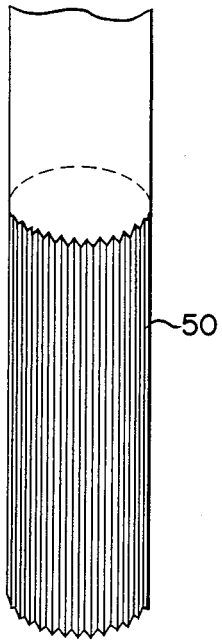
FIG. 2 is a perspective view of a condensation-heat exchanger of the helium cooling apparatus shown in FIG. 1.

Condensation-heat exchanger 24 is attached to the distal end of transfer line 23. The outside diameter of heat exchanger 24 is substantially equal to that of line 23. Exchanger 24 is located in a helium gas region inside liquid-helium container 11. Inner and outer pipes 38 and 39 of transfer line 23 terminate in a predetermined space inside heat exchanger 24. Within this space, the refrigerant is evaporated, thereby cooling a heat-transfer surface of the heat exchanger. To attain this, exchanger 24 is formed from oxygen-free copper having a good thermal conductivity. As shown in FIG. 2, moreover, grooves 50 are formed on the peripheral surface or heat-transfer surface of heat exchanger 24, extending in the axial or gravitational direction. These grooves will be described in detail later.

Constructed in this manner, the helium cooling apparatus of the invention cools the helium in the liquid-helium container as follows.

When helium gas recovery pipe 17 is closed, liquid-helium container 11 is sealed hermetically. Meanwhile, seal member 25 is used to seal the gap between liquid-helium injection pipe 16 and transfer line 23. If container 11 is left as it is, in this state, the liquid helium therein is evaporated, so that the pressure inside the container increases.

In this state, compressors 36 and 42 are actuated to drive helium cooling apparatus 1. Thereupon, the refrigerant starts to flow through outgoing line 38. The refrigerant, whose temperature is about 300° K. at the start, is cooled to about 60° K. by heat exchangers 33 and 40. Thereafter, it is cooled further to about 16° K. by heat exchangers 34 and 41, and then to about 5° K. by heat exchanger 35. Furthermore, the refrigerant is subjected to Joule-Thomson expansion by Joule-Thomson valve 37, so that its pressure is lowered to about 1 atm. Thus, the refrigerant, at a pressure of about 1 atm. and a temperature of 4.2° K., is fed into condensation-heat exchanger 24, through inner pipe 43 of transfer line 23. The refrigerant is evaporated by being boiled in heat exchanger 24. As a result, the heat-transfer surface of exchanger 24 is cooled. Accordingly, heat inside liquid-helium container 11 is transferred through the heat-transfer surface to exchanger 24.

When the pressure inside container 11 reaches the saturated vapor pressure for the temperature of the heat-transfer surface, the helium gas condenses and reliquefies on the transfer surface.

Meanwhile, according to the present invention, grooves 50 are formed on the heat-transfer surface so as to extend in the gravitational direction. Therefore, a wide heat-transfer area can be secured, and the liquid helium adhering to the transfer surface can drop along grooves 50. Thus, the condensation-heat transfer coefficient of the cooling device is improved considerably. The action of the liquid helium adhering to grooves 50 will be described in detail later.

In this manner, the pressure inside liquid-helium container 11 is kept constant. Liquid helium 14 does not change in quantity, and the object of cooling is cooled continuously for a long period of time.

Figure 3:
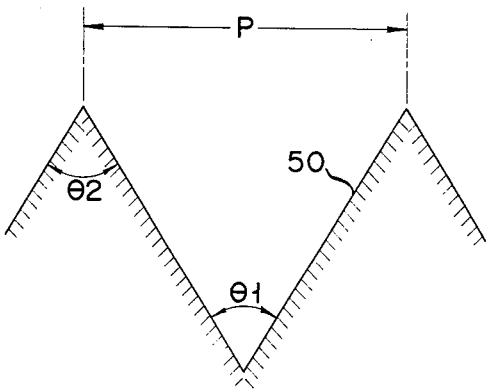
FIG. 3 is a sectional view of a groove in the heat exchanger shown in FIG. 2.

As shown in FIG. 3, each groove 50 on the heat-transfer surface is triangular in shape. The bottom and each edge top of groove 50 are acute-angled. The distance between the two edge tops of each groove 50 is referred to as pitch P. The angle formed by the bottom of groove 50 is $\theta 1$, while the angle formed by each edge top is $\theta 2$. Angles $\theta 1$ and $\theta 2$ are substantially equal.

The inventors hereof conducted an experiment to examine the heat transfer coefficient of the condensation-heat exchanger, while variously changing pitch P and angles $\theta 1$ and $\theta 2$.

Figure 4:
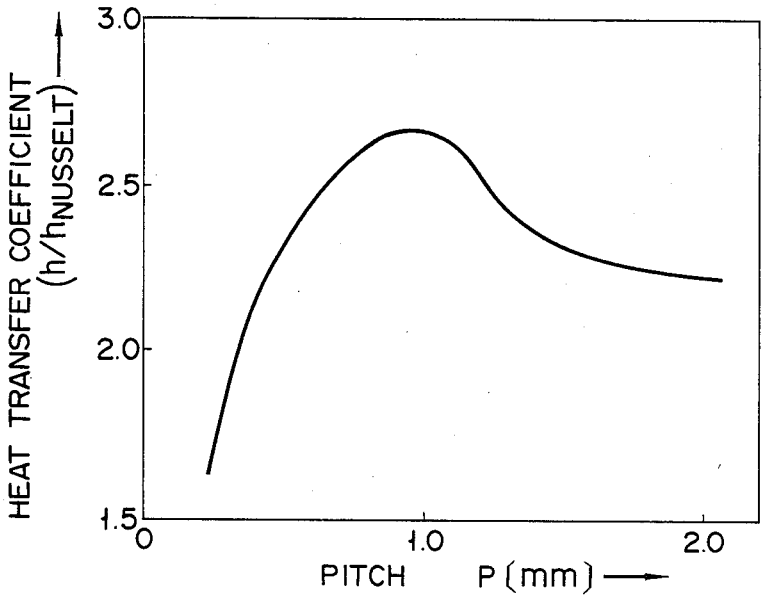
FIG. 4 is a graph showing a relation between the groove pitch and the heat transfer coefficient of the heat exchanger.

FIG. 4 shows an experiment result obtained with use of varying pitches. The curve of FIG. 4 represents the relationship between pitch P and value $h/h_0$, where $h_0$ is the condensation-heat transfer coefficient obtained without any grooves on the heat-transfer surface, and h is the heat transfer coefficient obtained when pitch P is changed as aforesaid. In other words, the curve of FIG. 4 indicates a transition of transfer coefficient h on the assumption that $h_0$ is 1. As seen from FIG. 4, if pitch P ranges from 800 to 1,200 μm, coefficient h is about 2.5 times as high as coefficient $h_0$. Thus, the heat transfer coefficient of heat exchanger 11 can be improved considerably by using pitch P within the aforesaid range.

Figure 6:
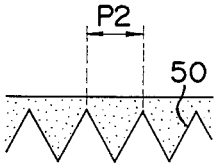

The following is the reason why the heat transfer coefficient changes according to the pitch. When the helium in liquid-helium container 11 is condensed by condensation-heat exchanger 24, the condensed liquid helium adheres to the heat-transfer surface of exchanger 24. For example, if pitch P of grooves 50 is narrow, as shown in FIG. 6, the adhering liquid helium covers the whole heat-transfer surface, thereby lowering the heat transfer coefficient thereof. In consequence, the heat-transfer surface cannot be improved in its heat transfer coefficient.

As the pitch of the grooves becomes greater, exceeding a predetermined value, the heat-transfer area diminishes. Thus, the greater the pitch of the grooves, the lower the heat transfer coefficient of the heat-transfer surface will be.

Figure 5:
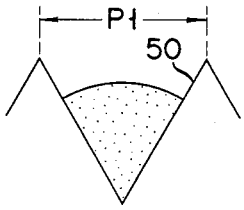
FIGS. 5 and 6 are sectional views of grooves in the heat exchanger, illustrating different groove pitches.

When the pitch of grooves 50 ranges from 800 to 1,200 μm, the condensed liquid helium adheres only to the bottom portion of each groove, as shown in FIG. 5. Therefore, the edge tops of each groove 50 are exposed from the liquid helium, and are in contact with the helium gas in liquid-helium container 11. Accordingly, the heat-transfer surface of the grooves cannot be covered with the condensed helium, so that a wide heat-transfer area can be secured. Thus, the heat transfer coefficient of the heat-transfer surface is improved considerably.

The inventors hereof also conducted an experiment in which angles $\theta 1$ and $\theta 2$ at the bottom and the edge top were changed variously, while keeping pitch P within the aforesaid range. In this experiment, the heat transfer coefficient of condensation-heat exchanger 11 was examined with angles $\theta 1$ and $\theta 2$ ranging from 30° to 70°. Thereupon, it was indicated that the heat transfer coefficient is constant without regard to bottom angle $\theta 1$. Thus, it is appreciated that the condensation-heat transfer coefficient cannot be influenced by the angles at the edge top or the bottom of grooves 50.

According to the present invention, as described herein, grooves with pitch P of 800 to 1,200 μm are formed on the heat-transfer surface of condensation-heat exchanger 24, extending in the gravitational direction. Thus, the heat transfer coefficient of the heat exchanger is improved considerably. Therefore, the heat exchanger of the invention is smaller in diameter than the prior art heat exchanger. In this arrangement, the port of the liquid-helium container, through which the exchanger is inserted into the container, need not have a large diameter. Therefore, the amount of heat entering the container through the port is very small. Since the heat exchanger is small-sized, moreover, the port for the insertion thereof need not always be an exclusive one. Thus, the condensation-heat exchanger according to the present invention may be used also in a liquid-helium container without an exclusive-use port.

Figure 7:
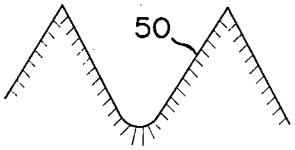
FIG. 7 is a sectional view of an arcuate-bottomed groove of the heat exchanger.

The bottom of each groove 50 need not always be acute-angled. Alternatively, it may be arcuate in shape, as shown in FIG. 7.

What is claimed is:

1. A helium cooling apparatus, comprising:

a liquid-helium container having a port with a predetermined diameter and containing liquid helium;

a cryostat adiabatically surrounding the liquid-helium container, and including a cylindrical member having one end connected to the port of the liquid-helium container, and the other end connected to the outside;

a refrigerator, located outside of the cryostat, for cooling a refrigerant;

a condensation-heat exchanger inserted into the liquid-helium container through both the cylindrical member and the port, the heat exchanger having a plurality of grooves formed on a heat-transfer surface thereof; so as to extend in the gravitational direction, the plurality of grooves being arranged at pitches of 800 to 1,200μ on the heat-transfer surface; and a transfer line for transferring the refrigerant, the transfer line extending through the cylindrical member and the port and connecting the refrigerator and the condensation-heat exchanger together, whereby the refrigerant is supplied from the refrigerator to the exchanger through the transfer line, the reefrigerant is evaporated in the heat exchanger, and condensed liquid helium adhering to the heat-transfer surface drops along the grooves when gas helium in the liquid-helium container is cooled to be recondensed.

2. The helium cooling apparatus according to claim 1, wherein the angle formed by the bottom of each said groove ranges from 30° to 70°.

3. The helium cooling apparatus according to claim 1, wherein the angle formed by each edge top of each said groove ranges from 30° to 70°.

4. The helium cooling apparatus according to claim 1, wherein each edge top of each said groove is acute-angled.

5. The helium cooling apparatus according to claim 1, wherein the bottom of each said groove is acute-angled.

6. The helium cooling apparatus according to claim 1, wherein the bottom of each said groove is arcuate in shape.

7. The helium cooling apparatus according to claim 1, wherein said refrigerator includes two closed-cycle cooling systems.

* * * * *